US009535393B2

(12) United States Patent
Katsuyama

(10) Patent No.: US 9,535,393 B2
(45) Date of Patent: Jan. 3, 2017

(54) IMAGE FORMING APPARATUS

(71) Applicant: Goro Katsuyama, Kanagawa (JP)

(72) Inventor: Goro Katsuyama, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/844,673

(22) Filed: Sep. 3, 2015

(65) Prior Publication Data

US 2015/0378305 A1 Dec. 31, 2015

Related U.S. Application Data

(63) Continuation of application No. 14/261,707, filed on Apr. 25, 2014, now Pat. No. 9,152,071.

(30) Foreign Application Priority Data

May 2, 2013 (JP) ..... 2013-097103
Mar. 6, 2014 (JP) ..... 2014-044273

(51) Int. Cl.
*G03G 15/00* (2006.01)
*G03G 21/16* (2006.01)
*G03G 15/01* (2006.01)

(52) U.S. Cl.
CPC ..... *G03G 21/1661* (2013.01); *G03G 15/0189* (2013.01); *G03G 21/1623* (2013.01); *G03G 21/1647* (2013.01)

(58) Field of Classification Search
CPC ..... G03G 15/04054; G03G 15/0865; G03G 15/0875; G03G 21/1647; G03G 21/1666; G03G 21/185
See application file for complete search history.

(56) References Cited

U.S. PATENT DOCUMENTS 6,308,024 B1 * 10/2001 Nakayama ..... B41J 29/12 399/92
7,877,037 B2 1/2011 Igarashi
7,937,014 B2 * 5/2011 Kawamata ..... G03G 21/206 399/110
2002/0150403 A1 10/2002 Katsuyama et al.
(Continued)

FOREIGN PATENT DOCUMENTS

JP 2007240703 A 9/2007
JP 2010058296 A 3/2010
(Continued)

*Primary Examiner* — Roy Y Yi
(74) *Attorney, Agent, or Firm* — Harness, Dickey & Pierce, P.L.C.

(57) ABSTRACT

An image forming apparatus includes a recording medium storage unit that stores therein a recording medium; an image forming unit that is arranged above the recording medium storage unit and that forms an image on the recording medium transferred from the recording medium storage unit; a storage-unit exterior member that covers a front side of the recording medium storage unit; an image-forming-unit exterior member that covers a front side of the image forming unit and that protrudes forward relative to the storage-unit exterior member; and a fresh air supply path that is arranged on a back side of the image-forming-unit exterior member, through which fresh air introduced from outside the image forming apparatus flows.

5 Claims, 12 Drawing Sheets

(56) References Cited

U.S. PATENT DOCUMENTS

| | | | | |
|---|---|---|---|---|
| 2002/0195915 | A1 | 12/2002 | Katsuyama et al. | |
| 2003/0052956 | A1 | 3/2003 | Katsuyama | |
| 2003/0170041 | A1 | 9/2003 | Katsuyama | |
| 2004/0114958 | A1 | 6/2004 | Katsuyama et al. | |
| 2007/0212104 | A1 | 9/2007 | Miyamoto et al. | |
| 2010/0098452 | A1* | 4/2010 | Inaba ..... | G03G 21/1853 399/92 |
| 2011/0181903 | A1 | 7/2011 | Katsuyama et al. | |
| 2012/0183314 | A1 | 7/2012 | Nishino et al. | |
| 2012/0294645 | A1 | 11/2012 | Shimada et al. | |

FOREIGN PATENT DOCUMENTS

| | | | |
|---|---|---|---|
| JP | 2013-008011 | A | 1/2013 |
| JP | 2013006484 | A | 1/2013 |

* cited by examiner

IMAGE FORMING APPARATUS

CROSS-REFERENCE TO RELATED APPLICATIONS

This patent application is a continuation of U.S. application Ser. No. 14/261,707, filed on Apr. 25, 2014, which is based on and claims priority to Japanese Patent Application No. 2013-097103 filed in Japan on May 2, 2013 and Japanese Patent Application No. 2014-044273 filed in Japan on Mar. 6, 2014, the entire contents of each of which is hereby incorporated by reference herein.

BACKGROUND OF THE INVENTION

1. Field of the Invention

The present invention relates to an image forming apparatus including a recording medium storage unit, an image forming unit that is arranged above the recording medium storage unit and that form an image on a recording medium obtained from the recording medium storage unit, and a recording medium conveying unit arranged between the recording medium storage unit and the image forming unit to convey the recording media.

2. Description of the Related Art

In electrophotographic image forming apparatuses, devices, such as intermediate transfer devices or fixing devices, that get hot are arranged inside main bodies of the apparatuses. Therefore, the image forming apparatuses include cooling mechanisms that introduce air from outside the apparatuses to maintain the inside temperature in an appropriate range, that cool, with the air, the devices to be hot, and that discharge the air after cooling to the outside of the apparatuses.

As such a cooling mechanism, Japanese Laid-open Patent Publication No. 2013-6484 and Japanese Laid-open Patent Publication No. 2007-240703 disclose a structure in which a cooling mechanism including a fan to blow air on the surface of an intermediate transfer belt, an air discharge fan, a ventilation duct, or the like are arranged on the outer side of the intermediate transfer belt to cool the intermediate transfer belt.

Incidentally, in an image forming apparatus capable of forming images at high speed, the amount of heat generated in the apparatus increases and it is increasingly necessary to mount a cooling mechanism with higher performance. Therefore, it is necessary to use a fresh air supply path (duct) with a larger cross-sectional area to introduce cooling air.

However, in the image forming apparatus, an image forming device including a developing device and a photoconductor drum, a secondary transfer device, a fixing device, an exposing device, a sheet conveying device, and the like are arranged without a space. Therefore, in reality, there is no extra space for arranging the fresh air supply path with a larger cross-sectional area. Furthermore, if the fresh air supply path is arranged around each of the devices inside the apparatus, the size of the main body of the apparatus including all of the devices and the fresh air supply path increases, resulting in the increased footprint.

Therefore, there is a need for an image forming apparatus capable of arranging a fresh air supply path with a larger cross-sectional area without increasing footprint.

SUMMARY OF THE INVENTION

According to an embodiment, an image forming apparatus includes a recording medium storage unit that stores therein a recording medium; an image forming unit that is arranged above the recording medium storage unit and that forms an image on the recording medium transferred from the recording medium storage unit; a storage-unit exterior member that covers a front side of the recording medium storage unit; an image-forming-unit exterior member that covers a front side of the image forming unit and that protrudes forward relative to the storage-unit exterior member; and a fresh air supply path that is arranged on a back side of the image-forming-unit exterior member, through which fresh air introduced from outside the image forming apparatus flows.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
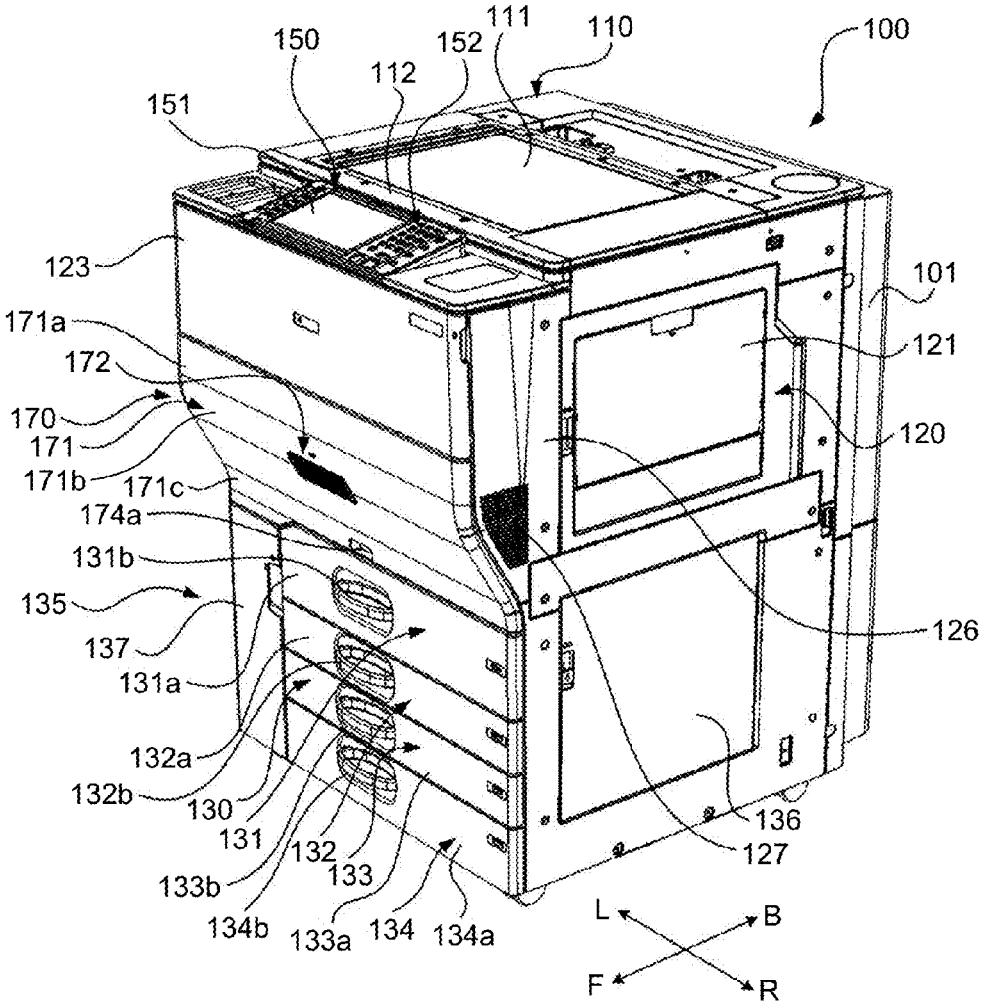
FIG. 1 is a perspective view illustrating an image forming apparatus according to an embodiment of the present invention.

Exemplary embodiments of an image forming apparatus according to the present invention will be explained below. First, an overall structure of the image forming apparatus will be described. FIG. 1 is a perspective view illustrating an image forming apparatus according to an embodiment of the present invention. An image forming apparatus 100 is a tandem color copier that forms a color image by fixing toner images of four colors of yellow, magenta, cyan, and black on a document. The image forming apparatus 100 includes a document reading unit 110 that optically reads documents, an image forming unit 120 that forms an image on a recording medium such as a sheet by an electrophotographic method, and a sheet storage unit 130 serving as a recording medium storage unit for storing sheets according to sheet sizes. The image forming apparatus 100 further includes an operating unit 150 that gives an instruction on operation of the image forming apparatus. The operating unit 150 is arranged on a top surface of the image forming apparatus 100 on an operator stand side (front side), where an operator of the document reading unit 110 stands, along a width direction (left-right direction). On the operating unit 150, a touch member 151, an operation button 152, and the like are arranged. Incidentally, in the drawings, the front side is indicated by F, the rear side is indicated by B, the right side is indicated by R, and the left side is indicated by L.

On the top surface of the document reading unit 110, a contact glass 111 as a document reading surface and a frame 112 are arranged. A pressurizing plate for pressing a document against the contact glass 111 and an auto document feeder (ADF) (both of which are not illustrated) are arranged above the document reading unit 110.

Figure 2:
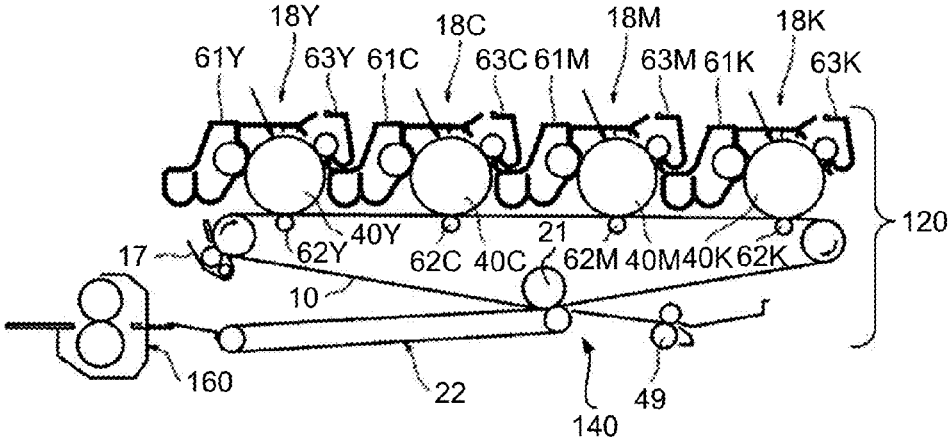
FIG. 2 is a schematic view illustrating an image forming unit and a secondary transfer unit of the image forming apparatus.

FIG. 2 is a schematic view illustrating the image forming unit of the image forming apparatus. The image forming unit 120 includes four image formation units 18Y, 18C, 18M, and 18K. In the image formation units 18Y, 18C, 18M, and 18K, developing devices 61Y, 61M, 61C, and 61K for yellow, magenta, cyan, and black develop latent images formed on four photoconductor drums 40Y, 40M, 40C, and 40K exposed by an exposing device, to thereby form toner images on the photoconductor drums 40Y, 40M, 40C, and 40K, respectively. The toner images formed on the photoconductor drums 40Y, 40M, 40C, and 40K are transferred to an intermediate transfer medium 10. A secondary transfer unit 140 then transfers, as secondary transfer, a full-color toner image transferred on the intermediate transfer medium 10 to a sheet.

The secondary transfer unit 140 includes secondary transfer rollers 21, a conveying belt 22, a cleaning device 17 of the intermediate transfer medium 10, and the like, forms a recording medium conveying path, and serves as a part of the image forming unit 120. Furthermore, a fixing device 160 is arranged in the image forming unit 120. Incidentally, reference symbols 62Y, 62C, 62M, and 62K denote secondary transfer rollers, reference symbols 63Y, 63C, 63M, and 63K denote cleaning devices that remove residual toner on the photoconductor drums 40Y, 40M, 40C, and 40K, respectively, and a reference numeral 49 denotes registration rollers that perform positioning of a conveyed recording medium and then feed the recording medium.

Moreover, a part or all of components included in the image formation units 18Y, 18C, 18M, and 18K form a process cartridge so that they can collectively be drawn from the image forming apparatus 100 to improve the maintainability.

A charging device uniformly charges the surfaces of the photoconductor drums 40Y, 40M, 40C, and 40K along with rotation of the photoconductor drums 40Y, 40M, 40C, and 40K, and the exposing device (not illustrated) applies writing light of laser, LEDs or the like to form electrostatic latent images on the photoconductor drums 40Y, 40M, 40C, and 40K.

Subsequently, the developing devices 61Y, 61M, 61C, and 61K apply toner to the photoconductor drums 40Y, 40M, and 40C to develop the electrostatic latent images, and a primary transfer device transfers the developed images onto the intermediate transfer medium 10. After the image formation, the cleaning devices 63Y, 63C, 63M, and 63K clean the surfaces of the photoconductor drums 40Y, 40M, and 40C by removing residual toner, and a neutralizing device neutralizes the surfaces of the photoconductor drums 40Y, 40M, and 40C for preparation for next image formation. Incidentally, the recording medium conveying path serving as a part of the image forming unit is a conveying path that covers the secondary transfer rollers 21 of the secondary transfer unit 140 and the conveying belt 22 toward the fixing device 160.

As illustrated in FIG. 1, the sheet storage unit 130 includes four sheet feed trays 131, 132, 133, and 134 according to sheet sizes for example. Each of the sheet feed trays 131, 132, 133, and 134 stores a bundle of sheets in a corresponding sheet size. The sheet feed trays 131, 132, 133, and 134 are formed so that they can be drawn toward the front side, and include front panels 131*a*, 132*a*, 133*a*, and 134*a* serving as storage-unit exterior members, respectively. All of the front panels 131*a*, 132*a*, 133*a*, and 134*a* are arranged entirely along a plane in the vertical direction. Furthermore, opening/closing operation units 131*b*, 132*b*, 133*b*, and 134*b* are arranged on the front panels 131*a*, 132*a*, 133*a*, and 134*a* to draw and push the sheet feed trays 131, 132, 133, and 134, respectively. Each of the opening/closing operation units 131*b*, 132*b*, 133*b*, and 134*b* is formed as a strap-shaped handle with an insertion opening in which an operator can put his/her finger.

Figure 3:
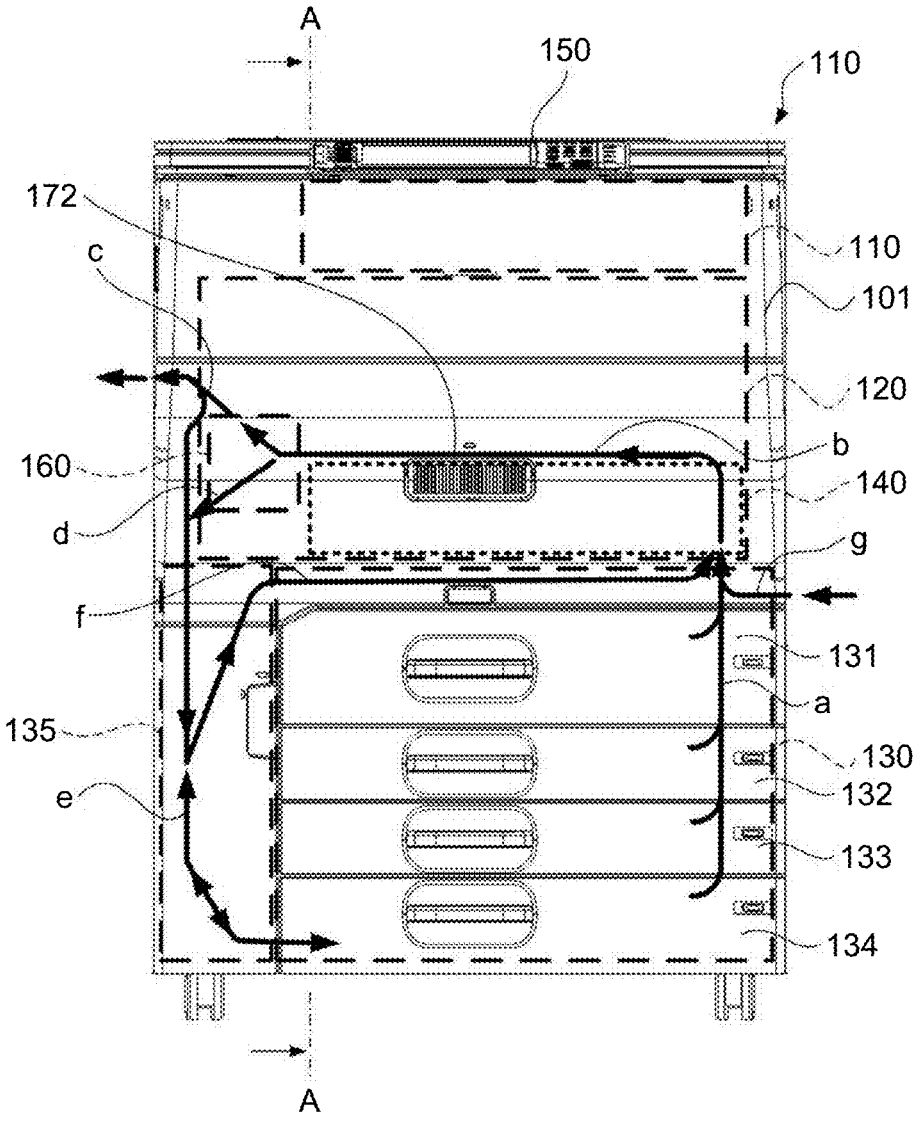
FIG. 3 is a schematic view illustrating processing units and sheet conveying paths of the image forming apparatus.

In the image forming apparatus 100, sheets stored in the sheet feed trays 131, 132, 133, and 134 of the sheet storage unit 130 are conveyed through paths as described below. FIG. 3 is a schematic view illustrating processing units and sheet conveying paths of the image forming apparatus. Specifically, in the case of one-side printing, a sheet conveying device conveys sheets one by one to the image forming unit 120 (path a in the drawing), a toner image formation process and a fixing process is performed on the sheet (path b in the drawing), and the sheet is discharged to a discharge tray (not illustrated) (path c). Furthermore, in the case of duplex printing, the sheet that has been subjected to printing on one side thereof is reversed by a reversing device. In this case, the reversing device moves the sheet to a purging unit 135 adjacent to the sheet storage unit 130 (paths d and e), and reverses the sheet by changing a sheet conveying direction (path f). Incidentally, in the case of manual feeding, a sheet is inserted via a manual feed tray (not illustrated) (path g).

The image forming apparatus 100 further includes a plurality of doors to remove, from the apparatus, a sheet jammed in the apparatus. Specifically, as illustrated in FIG. 1, the image forming unit 120 includes a manual feed door 121, the sheet storage unit 130 includes a sheet-storage-unit door 136 in a vertical conveying path, and the purging unit 135 of the reversing device includes a purging-unit door 137. Furthermore, the image forming apparatus 100 includes a toner replacement door 123.

Figure 4:
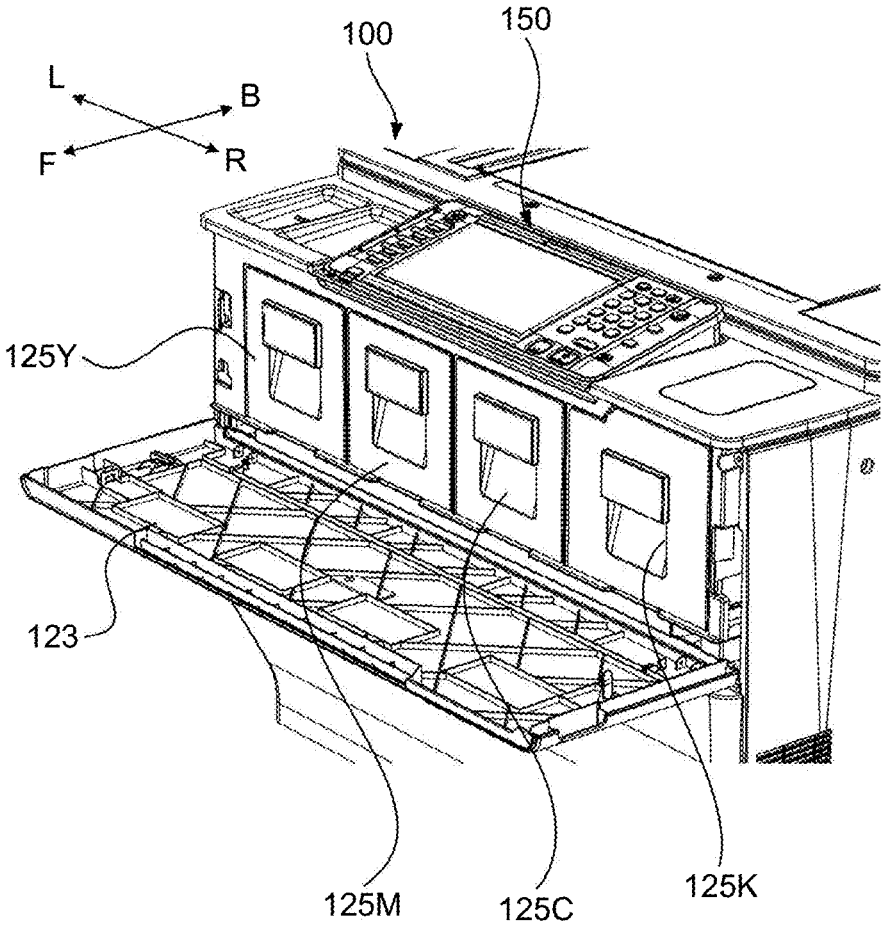
FIG. 4 is a perspective view illustrating a state in which a toner replacement door of the image forming apparatus is opened.

FIG. 4 is a perspective view illustrating a state in which the toner replacement door of the image forming apparatus is opened. A yellow toner container 125Y, a magenta toner container 125M, a cyan toner container 125C, and a black toner container 125K are arranged on the back side of the toner replacement door 123. The top surface of each of the toner containers 125Y, 125M, 125C, and 125K is arranged below the top exterior panel without a space. Therefore, the capacity of each of the toner containers 125Y, 125M, 125C, and 125K can be maximized.

Figure 5A:
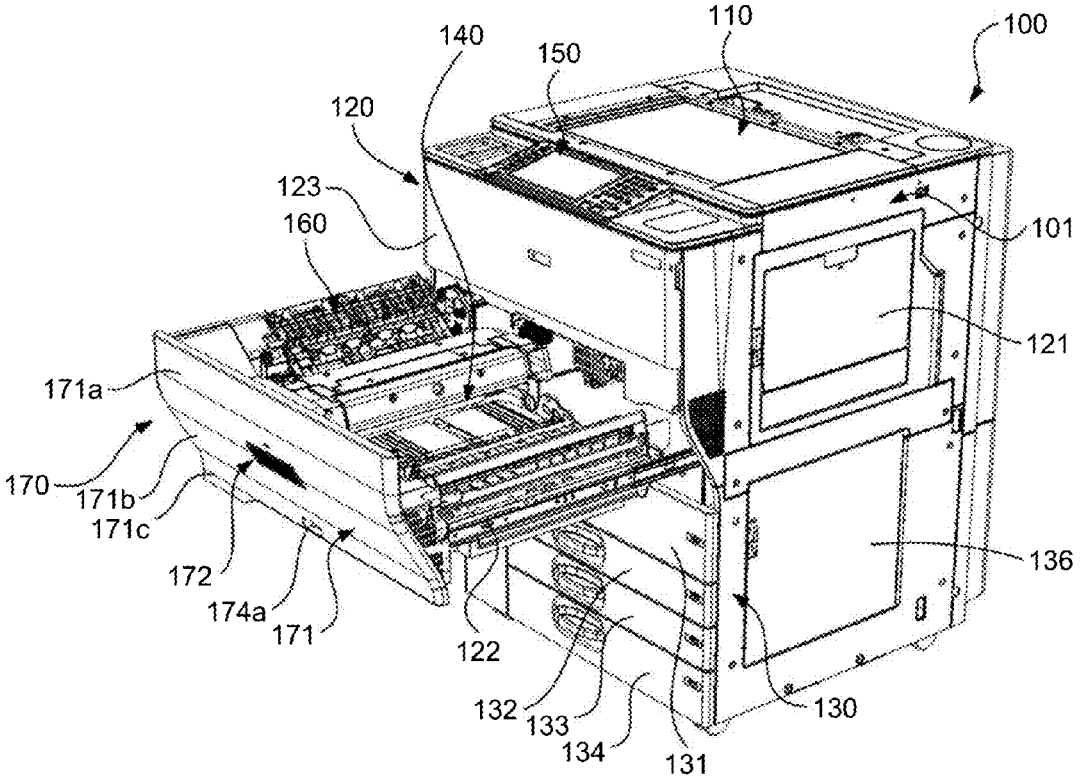
FIG. 5A is a perspective view illustrating a state in which a drawer unit of the image forming apparatus is drawn.
Figure 5B:
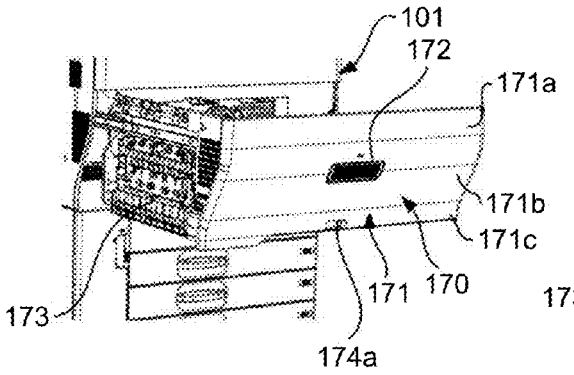
FIG. 5B is a perspective view illustrating a state in which the drawer unit is drawn, when viewed from a different direction.
Figure 5C:
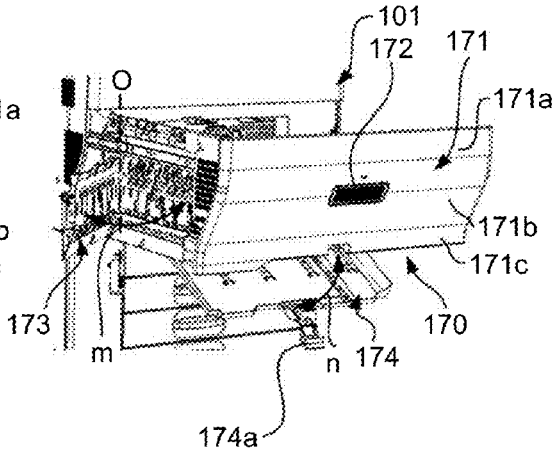
FIG. 5C is a perspective view illustrating a state in which doors of the drawer unit are opened.

In the image forming unit 120, the secondary transfer unit 140 and the fixing device 160 are mounted on a drawer unit 170 that is drawable toward the front side from a main body 101 of the image forming apparatus 100. FIG. 5A is a perspective view illustrating a state in which the drawer unit of the image forming apparatus is drawn, FIG. 5B is a perspective view illustrating a state in which the drawer unit is drawn, when viewed from a different direction, and FIG. 5C is a perspective view illustrating a state in which doors of the drawer unit are opened. As illustrated in FIG. 5A, the drawer unit 170 is drawn from the main body 101 along a rail 122. A front plate 171 is arranged on the drawer unit 170, and the front plate 171 and the toner replacement door 123 serve as an image-forming-unit exterior member. Incidentally, the exposing device and the photoconductor drums 40Y, 40M, and 40C are arranged on the back side of the the toner replacement door 123. Therefore, the toner replacement door 123 serves as the image-forming-unit exterior member that covers the image forming unit 120. Furthermore, on the back side of the front plate 171, the intermediate transfer medium 10, the secondary transfer unit 140 (including the secondary transfer rollers 21 and the conveying belt 22 toward the fixing device 160), the fixing device 160, and a part of the purging unit 135 are arranged. Moreover, the drawer unit 170 includes the secondary transfer unit 140 (including the secondary transfer rollers 21 and the conveying belt 22 toward the fixing device 160), the fixing device 160, and a part of the purging unit 135. Incidentally, in this example, the intermediate transfer medium 10 is not drawn.

Furthermore, the front plate 171 of the drawer unit 170 is formed so as to protrude forward relative to the front panels 131*a*, 132*a*, 133*a*, and 134*a*. The front plate 171 is downwardly inclined toward the rear side. On the front plate 171 serving as an outer surface of the drawer unit 170, a drawer operation unit 172 is formed to perform drawing operation and pushing operation on the drawer unit 170. Specifically, the front plate 171 includes an upper flat surface 171*a*, an inclined surface 171*b*, and a lower flat surface 171*c*, and curved surfaces are formed between all of the surfaces. Moreover, as illustrated in FIGS. 5B and 5C, the drawer unit 170 includes a side door 173 to remove a sheet from the side of the fixing device 160 and a lower door 174 to remove a sheet from a duplex conveying path below the secondary transfer unit 140. The side door 173 is configured to be opened and closed in the width direction of the apparatus with respect to the drawer unit 170 about a rotary shaft O arranged on the side surface of the drawer unit 170 (in directions of arrow m in the drawing). Furthermore, the lower door 174 that rotates in the vertical direction of the apparatus is configured to be opened and closed in a downward direction about the rear side by operation of a handle 174*a* (in directions of arrow n in the drawing). Therefore, even when the drawer unit 170 is pushed to the inside of the apparatus while the side door 173 or the lower door 174 is left opened or is not fully closed, the side door 173 or the lower door 174 being left opened rotates in a closing direction by coming into contact with the main body of the apparatus. As a result, it becomes possible to prevent the side door 173 and the lower door 174 from being damaged. Furthermore, it becomes possible for a user to omit operation of closing the side door 173 and the lower door 174. Meanwhile, the handle 174*a* for opening and closing the lower door 174 is arranged on the lower door 174.

Figure 6A:
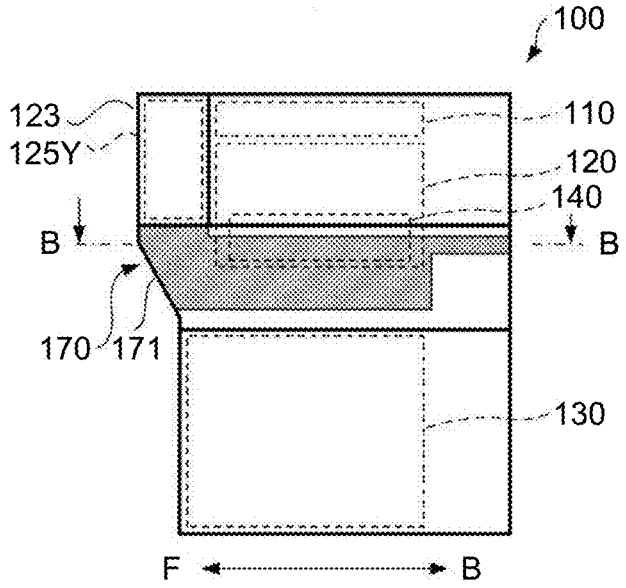
FIG. 6A is a schematic cross-sectional view illustrating a fresh air supply path of the image forming apparatus taken along a line A-A in FIG. 3.
Figure 6B:
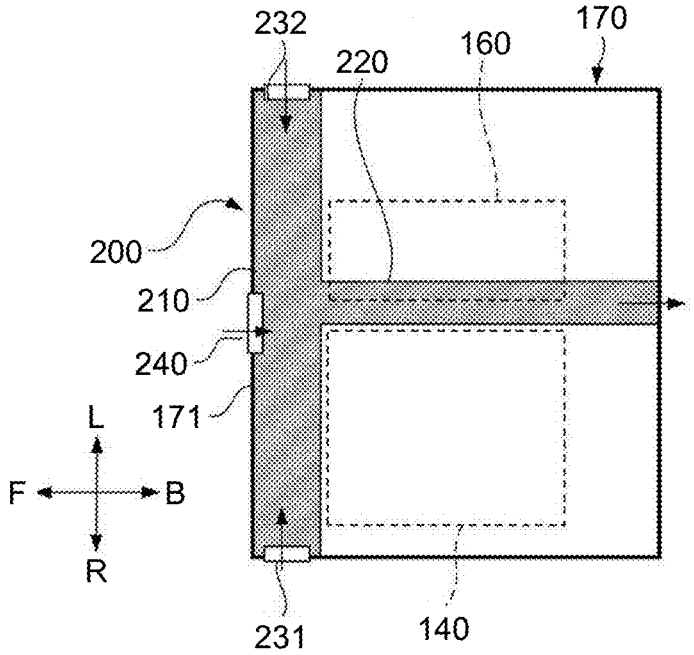
FIG. 6B is a schematic cross-sectional view illustrating the fresh air supply path taken along a line B-B in FIG. 6A.
Figure 7:
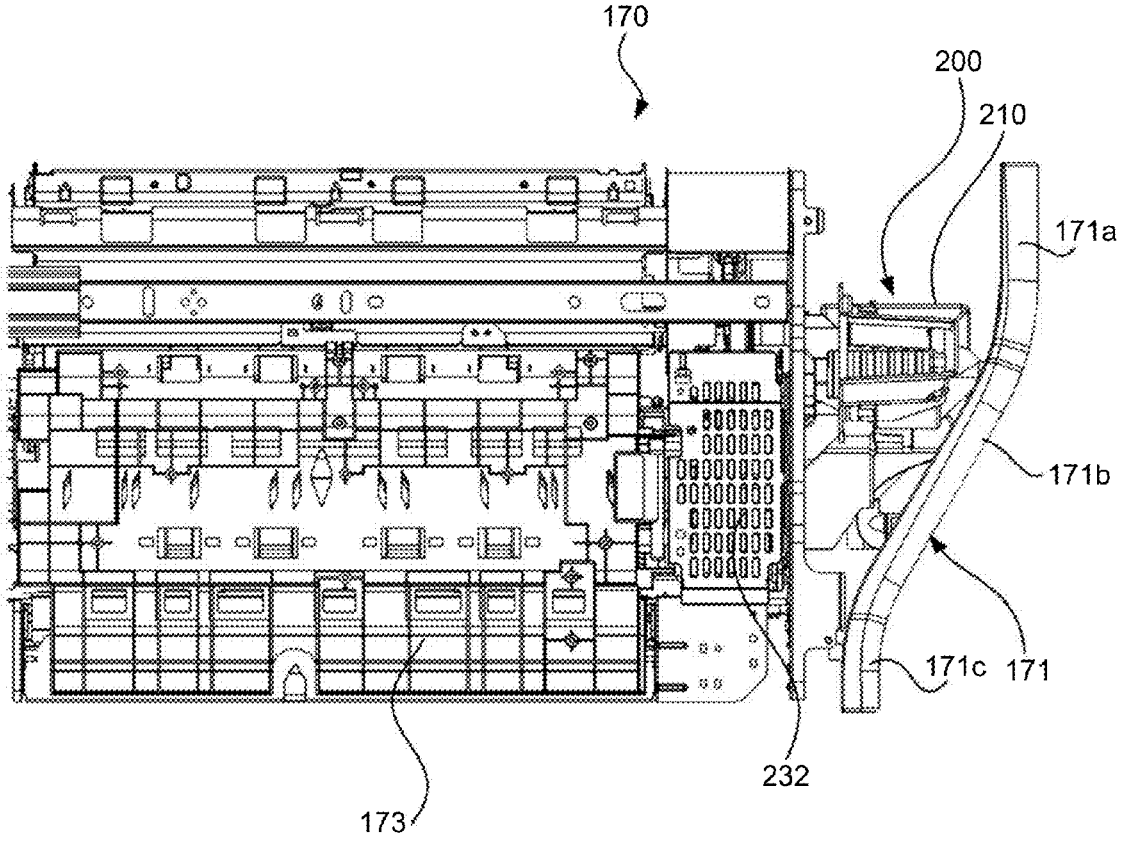
FIG. 7 is a side view illustrating the drawer unit of the image forming apparatus.
Figure 8:
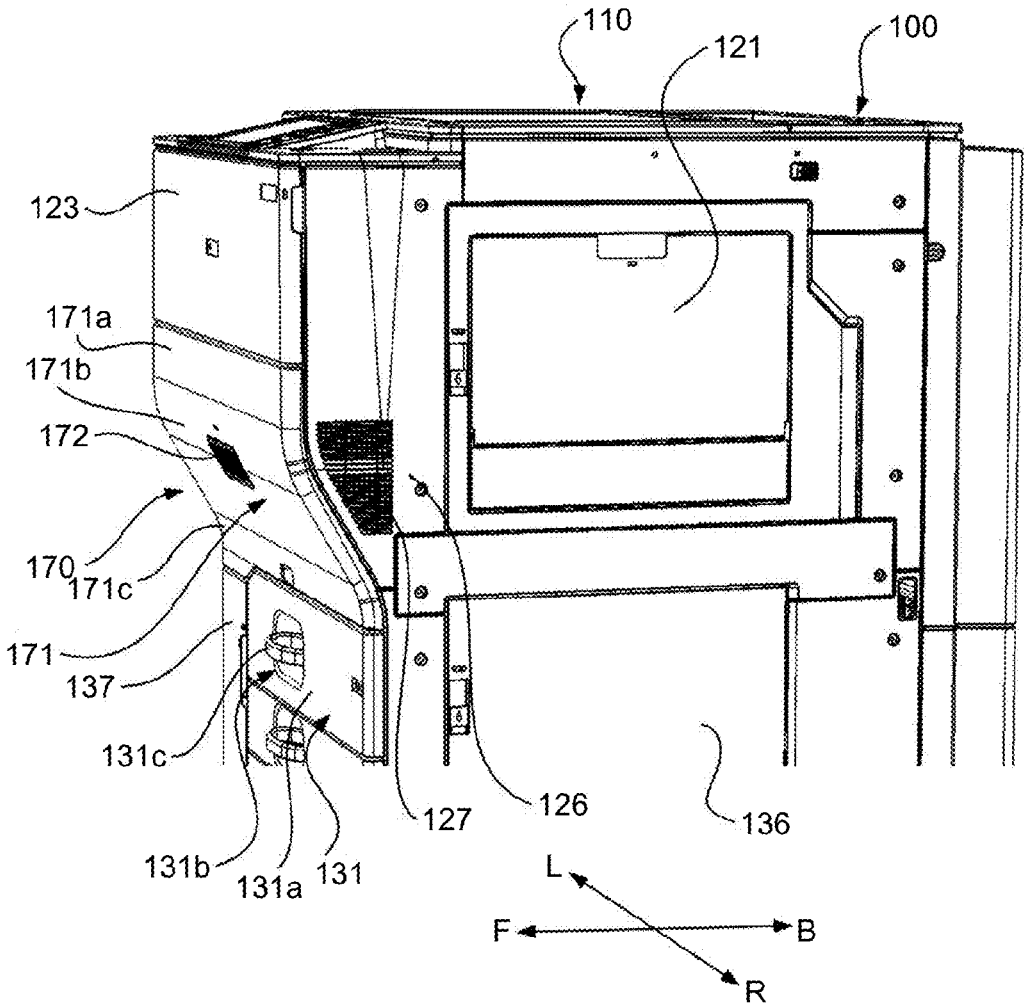
FIG. 8 is a perspective view of the image forming apparatus viewed from the right side.

FIG. 6A is a schematic cross-sectional view illustrating a fresh air supply path of the image forming apparatus taken along a line A-A in FIG. 3, and FIG. 6B is a schematic cross-sectional view illustrating the fresh air supply path taken along a line B-B in FIG. 6A. FIG. 7 is a side view illustrating the drawer unit of the image forming apparatus, and FIG. 8 is a perspective view of the image forming apparatus when viewed from the right side. In the image forming apparatus 100, to cool the inside of the apparatus, a fresh air supply path 200 is arranged on the inner side of the front plate 171 of the drawer unit 170, through which fresh air introduced from outside the image forming apparatus flows.

The fresh air supply path 200 includes a widthwise supply path 210 arranged along the width direction of the drawer unit 170 on the inner side of the front plate 171, and includes a depthwise supply path 220 that extends from the widthwise supply path 210 toward the rear side. The fresh air supply path 200 includes, as fresh air inlets, a right air inlet 231 and a left air inlet 232 on both side surfaces perpendicular to the drawing direction and also includes a front air inlet 240. Fresh air is introduced via each of the air inlets 231, 232, and 240. In the image forming apparatus 100 according to the present embodiment, the front air inlet 240 is arranged on the drawer operation unit 172 of the drawer unit 170. Furthermore, an electric fan (not illustrated) is arranged in the fresh air supply path 200. The introduced fresh air is conveyed to the secondary transfer unit 140 or the fixing device 160 to cool the secondary transfer unit 140 or the fixing device 160. Incidentally, the fresh air inlets may be arranged on only one side in the left-right direction. Furthermore, various structures may be employed as the fresh air supply path 200. For example, the fresh air supply path 200 may be configured to introduce air from one of the right air inlet 231 and the left air inlet 232 and discharge air from the other one of the right air inlet 231 and the left air inlet 232.

As illustrated in FIG. 8, in the image forming apparatus 100 according to the present embodiment, on the outer side of the right air inlet 231 arranged in the drawer unit 170, a right panel 126 is arranged to cover the right side surface of the image forming unit 120, and a louver 127 for ventilation is arranged on the right panel 126. The right air inlet 231 and the louver 127 are arranged in the same position. The left air inlet 232 has the same structure as described above.

Figure 9A:
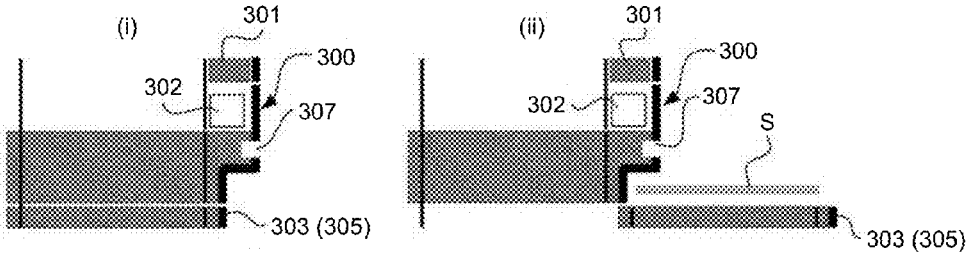
FIGS. 9A to 9C are schematic views illustrating a relationship between the shape of the drawer unit and sheet feeding to the sheet feed tray.
Figure 9B:
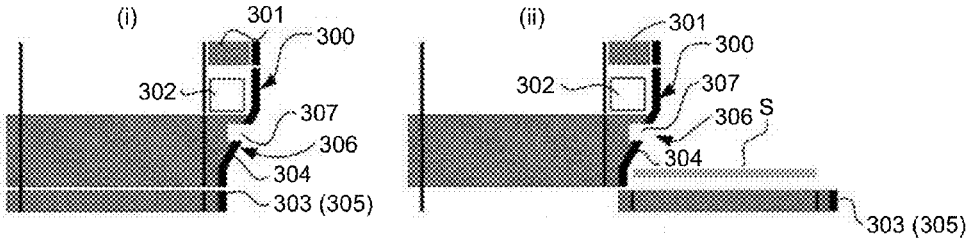
Figure 9C:
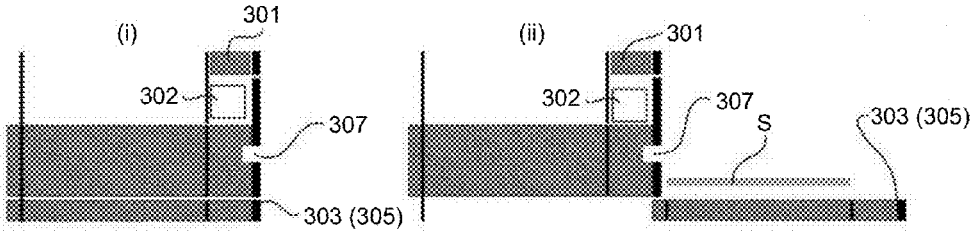
Figure 9D:
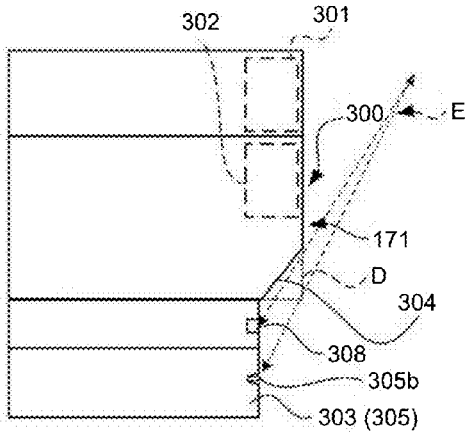
FIG. 9D is a schematic view for explaining the visibility of a handle of a lower door and an opening/closing operation unit of the sheet feed tray.

The reason why a protruding part is formed such that the image-forming-unit exterior member protrudes forward relative to the storage-unit exterior member and the reason why the front plate 171 serving as a part of the protruding part is inclined will be described below. FIG. 9A is a schematic view illustrating a relationship between the shape of the drawer unit and sheet feeding to the sheet feed tray, when the protruding part is formed without an inclined part, FIG. 9B illustrates the relationship when the protruding part and the inclined part are formed, and FIG. 9C illustrates the relationship when the protruding part is not formed. Furthermore, in FIGS. 9A to 9C, (i) illustrates a use state in which the sheet feed tray is pushed in the image forming apparatus, and (ii) illustrates a sheet replenishing state in which the sheet feed tray is drawn. Moreover, FIG. 9D is a schematic view for explaining the visibility of the handle 174*a* of the lower door 174 and the opening/closing operation unit 131*b* of the sheet feed tray 131.

First, the reason why a protruding part is formed such that the image-forming-unit exterior member protrudes forward relative to the storage-unit exterior member will be explained below. If the depth of a toner container 301 is increased or a fresh air supply path 302 is arranged in the image forming unit, the footprint of the image forming apparatus in a state in which the sheet feed tray is pushed in is increased (FIG. 9C(i)). In contrast, if a protruding part 300 is provided to cause the image-forming-unit exterior member to protrude forward relative to the storage-unit exterior member, it becomes possible to increase a storage space of the toner container and ensure a space for the fresh air supply path without increasing the footprint (FIG. 9A(i) and FIG. 9B(i)). Furthermore, in the configuration in which the protruding part 300 is provided, it becomes possible to reduce even the footprint of the image forming apparatus in the sheet replenishing state in which the sheet feed tray is drawn compared to the configuration in which the protruding part 300 is not provided (FIG. 9A(ii), FIG. 9B(ii), and FIG. 9C(ii)). Incidentally, a drawer operation unit 307 (corresponding to the drawer operation unit 172) is arranged on an inclined surface 304.

Next, the reason why the front plate 171 is inclined will be explained with reference to FIGS. 9A, 9B, and 9D. In the configuration in which the inclined surface 304 is not provided on the front plate 171 (FIG. 9A), an opening/closing operation unit 305*b* (corresponding to the opening/closing operation unit 131*b* in FIG. 1) of a sheet feed tray 305 (corresponding to the sheet feed tray 131 in FIG. 1) of a sheet storage unit 303 and a handle 308 (corresponding to the handle 174*a* in FIG. 5C) for opening and closing a lower door (corresponding to the lower door 174 in FIG. 5C) of a drawer unit 306 may be hidden from the front side because a line of sight E of a user is blocked by a lower corner D (indicated by a broken line in FIG. 9D) of a step located in the upper portion. In contrast, in the configuration in which the inclined surface 304 is provided on the front plate 171 (FIGS. 9B and 9D), the lower corner D (indicated by the broken line in FIG. 9D) is removed, so that the opening/closing operation unit 305*b* of the sheet feed tray 305 and the handle 308 for opening and closing the lower door can be viewed easily from the front side. Furthermore, when a bundle of sheets S is replenished to the sheet storage unit 303, the lower corner D (see FIG. 9D) of the protruding part 300 blocks the line of sight E of the user in the configuration in which the inclined surface 304 is not provided in the front plate 171 (FIG. 9A), but such a situation can hardly occur in the configuration in which the inclined surface 304 is provided in the front plate 171 (FIGS. 9B and 9D).

Figure 10:
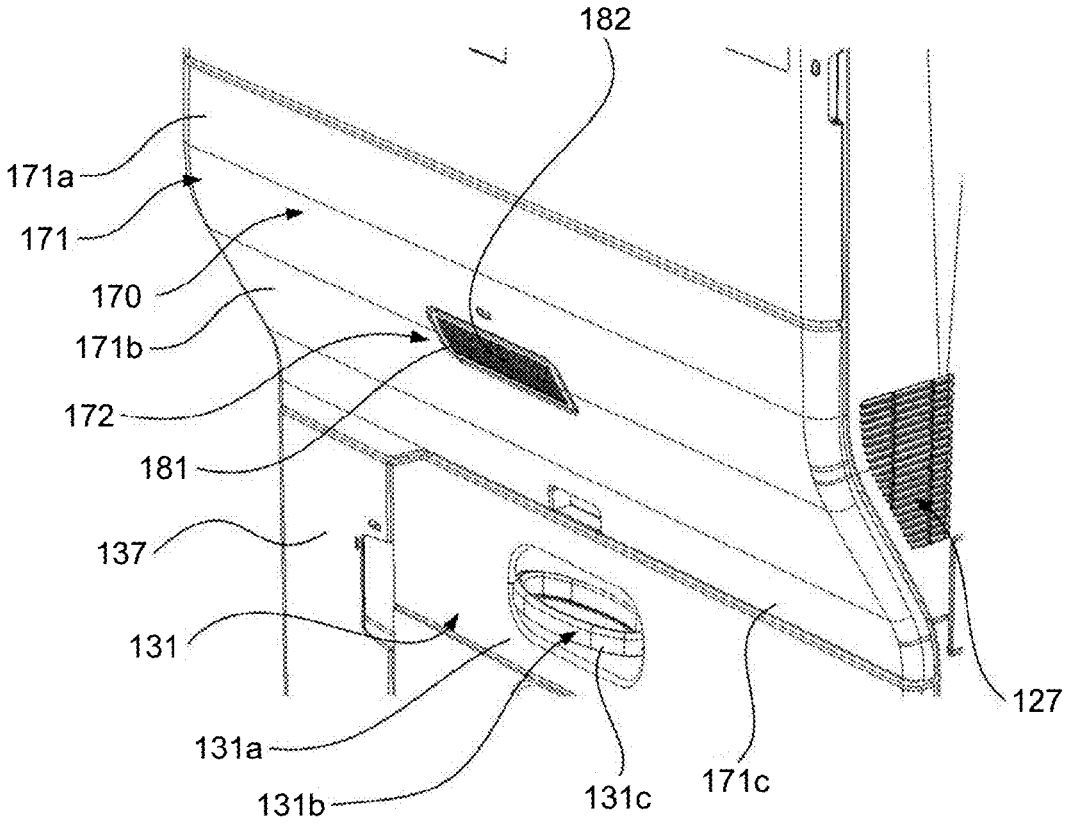
FIG. 10 is a perspective view illustrating a drawer operation unit of the drawer unit and the opening/closing operation unit of the sheet feed tray in the the image forming apparatus.
Figure 11A:
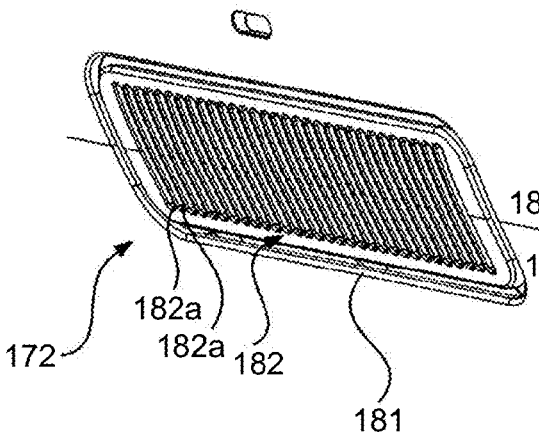
FIG. 11A is an external perspective view of a cover arranged on a handle of the image forming apparatus, when in a closed state.
Figure 11B:
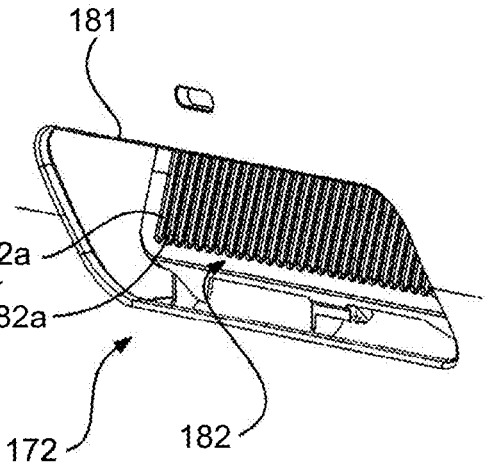
FIG. 11B is an external perspective view of the cover in an open state.
Figure 11C:
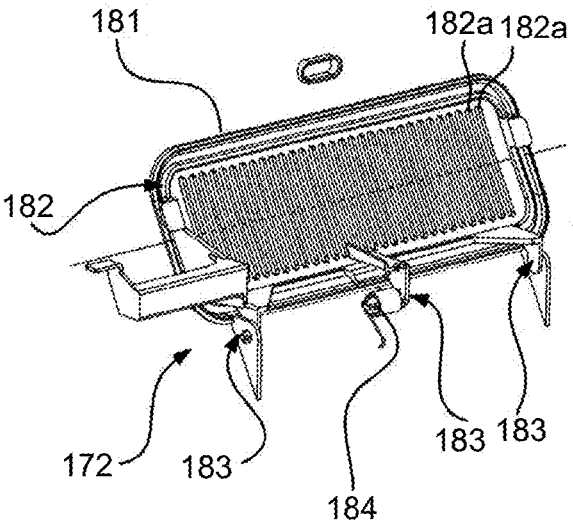
FIG. 11C is an internal perspective view of the cover in the closed state.
Figure 11D:
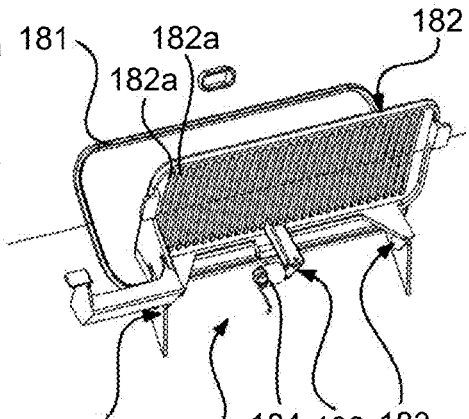
FIG. 11D is an internal perspective view of the cover in the open state.
Figure 12:
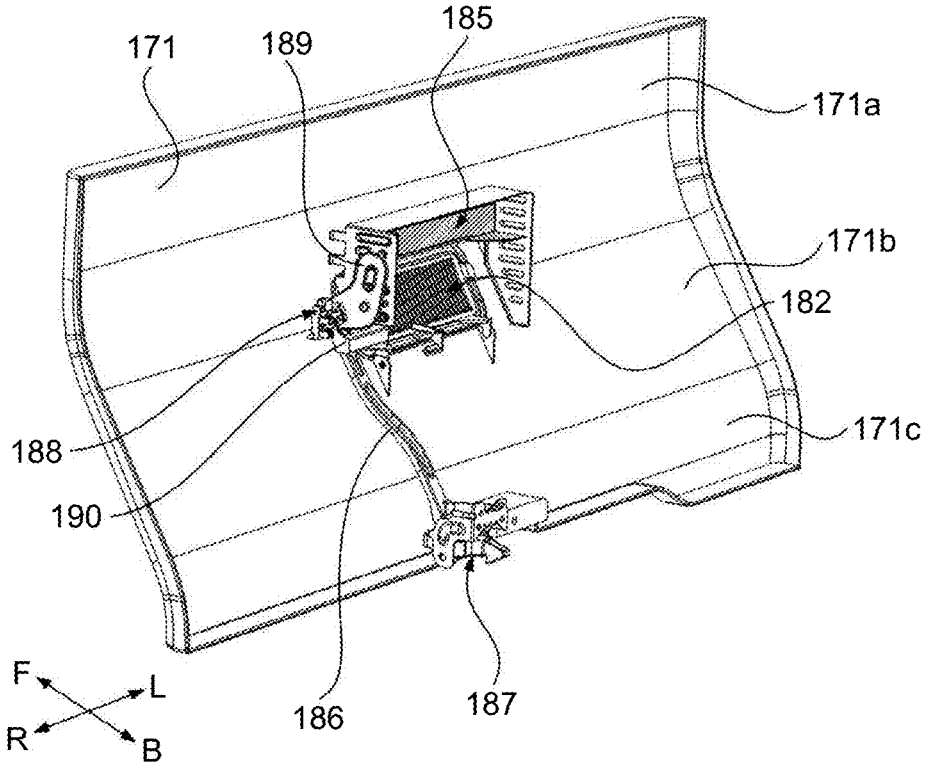
FIG. 12 is a perspective view illustrating a locking device of the drawer unit of the image forming apparatus.

Next, the drawer operation unit 172 will be explained. In the present embodiment, the drawer operation unit 172 communicates with the widthwise supply path 210 and serves as the front air inlet 240. FIG. 10 is a perspective view illustrating the drawer operation unit of the drawer unit and the opening/closing operation unit of the sheet feed tray in the image forming apparatus. FIG. 11A is an external perspective view of a cover arranged on the handle of the image forming apparatus, in a closed state, FIG. 11B is an external perspective view of the cover in an open state, FIG. 11C is an internal perspective view of the cover in the closed state, and FIG. 11D is an internal perspective view of the cover in the open state. FIG. 12 is a perspective view illustrating a locking device of the drawer unit of the image forming apparatus.

As illustrated in FIG. 10, the opening/closing operation unit 131*b* includes a strap-shaped gripper 131*c*. In contrast, the drawer operation unit 172 includes a hole 181, which is communicated with the widthwise supply path 210 and in which an operator's finger is insertable, on the front plate 171 of the drawer unit 170, and includes a rotatable cover 182 on the hole 181.

In the present embodiment, the handle (a portion which is arranged on the back side of the hole 181 on the front plate 171 and in which a user puts his/her finger, that is, a release member 185 in FIG. 12) of the drawer operation unit 172 and the opening/closing operation unit 131*b* are arranged at different positions on the front plate 171 and the sheet feed tray 131 serving as the exterior members, respectively. Specifically, the handle of the drawer operation unit 172 is arranged on the back side of the front plate 171, whereas the gripper 131*c* of the opening/closing operation unit 131*b* of the sheet feed tray 131 is arranged on the front side of the front panel 131*a*. Therefore, the appearance of the drawer operation unit 172 of the drawer unit 170 and the appearance of the opening/closing operation unit 131*b* of the sheet feed tray 131 are distinguished from each other. Furthermore, by attaching the cover 182 to the hole 181 of the drawer operation unit 172, a difference in impressions of the appearances is intensified. As described above, according to the present embodiment, it becomes possible to prevent false recognition between the drawer operation unit 172 of the drawer unit 170 and the opening/closing operation unit 131*b* of the sheet feed tray 131.

As illustrated in FIGS. 11A to 11D, the cover 182 is rotatable such that the upper portion is opened with respect to rotation supporters 183 holding a rotary shaft of the cover 182 below the hole 181, and, in a normal state, is pressed by a spring member 184 in a closing direction to close the hole 181. Furthermore, by providing the cover 182, the drawer operation unit 172 becomes unnoticeable, so that it becomes possible to reduce the chance that an operator erroneously draw the drawer unit 170 in the first place when a paper jam or the like has occurred.

Namely, in the image forming apparatus 100 according to the present embodiment, both of the sheet feed tray 131 and the drawer unit 170 are drawable. Therefore, it may be possible to confuse the drawer unit 170 with the drawer of the sheet feed tray 131. Therefore, it is necessary to enable a user to distinguish these units as different units. To cope with this, as described above, the handle of the drawer operation unit 172 of the drawer unit 170 is arranged on the back side of the front plate 171, the hole 181 serving as a finger insertion opening is hidden by the cover 182, and the drawer operation unit 172 of the drawer unit 170 becomes unnoticeable to prevent the user from accessing them carelessly. If it becomes necessary to access the drawer unit 170, the user is notified of the need to access the drawer operation unit 172 by a lamp provided on the drawer operation unit 172 or animation on the operation panel.

In the image forming apparatus 100, an operator is able to put his/her finger on the upper edge of the hole 181 by pushing the cover 182 with fingers. Therefore, the operator can move the drawer unit 170 with underhand grip. Consequently, even when the drawer unit 170 is heavy, it becomes possible to prevent wrist ache or arm ache due to moving of the drawer unit 170. The hole 181 may be arranged in a position on the center of gravity line of the drawer unit 170.

For example, the hole 181 may be arranged in the center of the drawer unit 170 in the width direction or in the center of the drawer unit in the vertical direction. Furthermore, the openings may be arranged in multiple portions.

Moreover, in the present embodiment, the drawer operation unit 172 is arranged in the upper position of the inclined surface 171*b* of the front plate 171. Therefore, the opening of the hole 181 of the drawer operation unit 172 faces obliquely downward, so that it becomes possible to guide a user to put his/her finger on with underhand grip. Furthermore, a space between the inclined surface 171*b* and the fixing device 160, the secondary transfer device, or the like of the drawer unit 170 is large, so that it becomes possible to ensure an adequate space for arranging a lock release mechanism (the release member 185, a rotation detecting unit 188, a shielding plate 189, or the like) that releases a locking device 187 arranged on the periphery of the drawer operation unit 172 as illustrated in FIG. 12. Moreover, it becomes possible to ensure a space for arranging the widthwise supply path 210 communicating with the hole 181. In contrast, if the drawer operation unit 172 is arranged on the lower flat surface 171*c*, a space formed with internal units is small, so that it becomes difficult to ensure an adequate space for arranging the lock release mechanism and the widthwise supply path 210. Furthermore, a mechanism serving as a heat source is located at the same position as the inclined surface 171*b* in the height direction; therefore, it is desirable to arrange the widthwise supply path 210 in the same position as the inclined surface 171*b* rather than the position of the upper flat surface 171*a*.

As illustrated in FIGS. 11A to 11D, the cover 182 includes a plurality of ventilation holes 182*a* through which fresh air passes. In this example, a number of vertically long slits are arranged side by side, as the ventilation holes 182*a*, on the cover 182. This is to prevent nails of fingers from getting caught on edges of the ventilation holes. Incidentally, the shape of the ventilation holes is not limited to this example, and other shapes, such as a circle, an ellipse, a diamond shape, or a horizontally long slit, may be employed.

Furthermore, as illustrated in FIG. 12, the release member 185 that releases the locking device 187 of the drawer unit 170 is arranged in the upper portion of the hole 181 on the back side of the front plate 171. By pulling the release member 185 toward the front side of the apparatus, the locking device 187 of the drawer unit 170 is released via a link 186. Moreover, the rotation detecting unit 188 that detects rotation of the cover 182 is provided, as a detecting means that detects insertion of fingers, on the cover 182 of the drawer operation unit 172. The rotation detecting unit 188 includes a shielding plate 189 that moves with rotation of the cover 182 to block light from a light-emitting unit (not illustrated) and a light detecting unit 190 that detects the light from the light-emitting unit, and detects fingers by detecting movement of the cover 182.

Incidentally, among the components that are in contact with one another while the drawer unit 170 is housed, some components may be drawn together with the drawer unit 170 and other components main remain on the main body of the apparatus when the drawer unit 170 is drawn. If the drawer unit 170 is drawn while the components are in contact with one another, the components may be damaged. Therefore, the rotation detecting unit 188 detects in advance that an operator is to draw the drawer unit 170 and separates the components before the operator actually draws the drawer unit 170, to thereby prevent the components from being damaged due to drawing of the drawer unit 170. Examples of the components as described above include a pair of the secondary transfer rollers 21 (see FIG. 2) of the secondary transfer unit 140. The locking device of the drawer unit 170 may be released by an electric motor or the like instead of manual operation.

Figure 13:
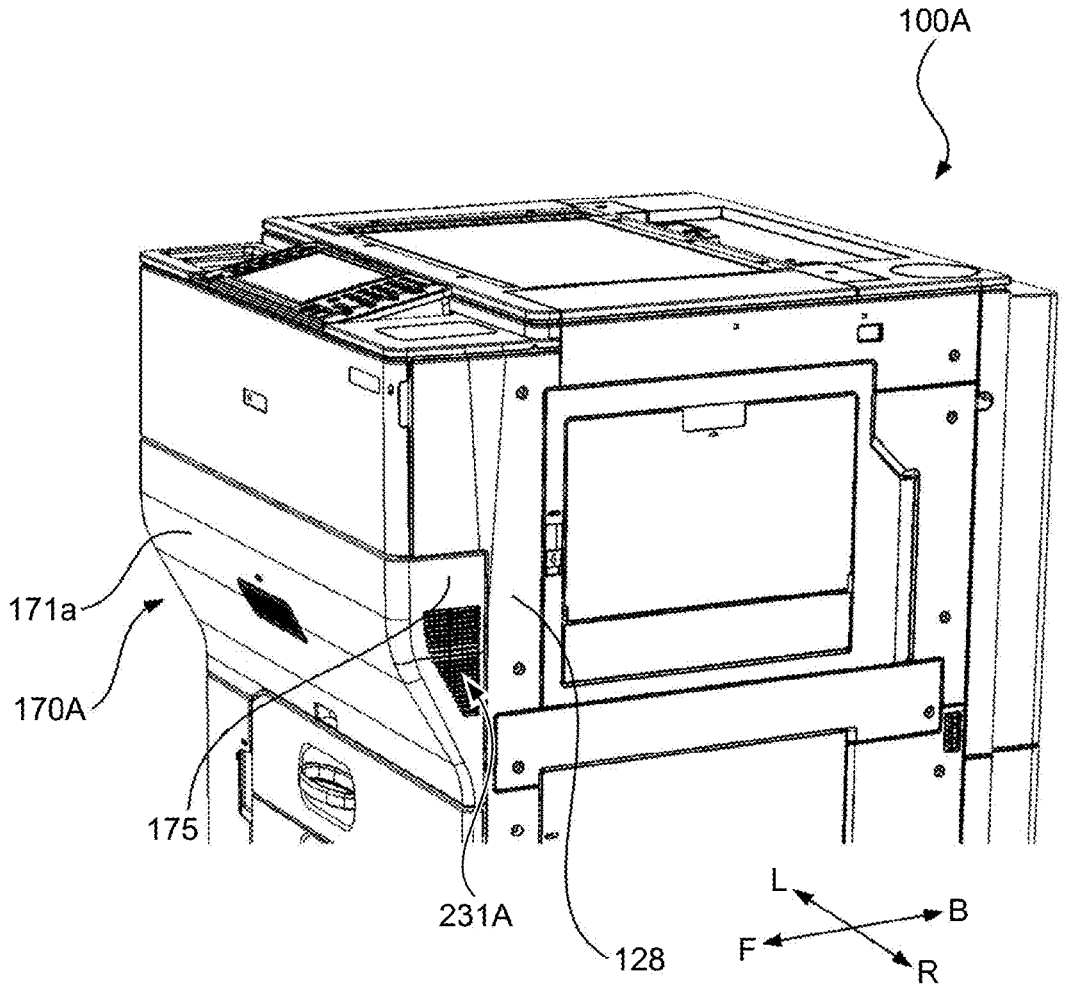
FIG. 13 is a perspective view illustrating an image forming apparatus according to a modification.

FIG. 13 is a perspective view illustrating an image forming apparatus according to a modification of the present embodiment. In an image forming apparatus 100A, a right air inlet 231A and a left air inlet (not illustrated) of the fresh air supply path arranged in a drawer unit 170A are directly exposed to the outside. In this example, the drawer unit 170A includes external panels 175 on right and left sides on which the right air inlet 231 and the left air inlet (not illustrated) are respectively formed. The external panels 175 is fitted to a notch of a right panel 128 of the image forming unit 120 so as to form the same surface as the right panel 128. In this example, it becomes possible to directly introduce fresh air into the widthwise supply path 210.

According to an embodiment of the present invention, it becomes possible to arrange a fresh air supply path with a large cross-sectional area without increasing the footprint, enabling to achieve high cooling efficiency.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit that forms an image on a recording medium; and a drawer unit that includes at least a recording medium conveying path constituting a part of the image forming unit to convey the recording medium in the image forming unit, and that is drawable toward a front side, wherein a front plate of the drawer unit constitutes a part of an outer surface of a main body of the image forming apparatus, and the front plate is formed with a hole which passes through the front plate and in which an operator's finger is insertable, and includes a rotatable cover to cover the hole.

2. The image forming apparatus according claim 1, further comprising a handle that is arranged on a back side of the front plate and above the opening.

3. The image forming apparatus according claim 1, wherein the front plate includes a rotation supporter to hold a rotary shaft of the cover below the opening.

4. The image forming apparatus according claim 1, wherein the cover includes a ventilation hole through which air outside of the main body passes.

5. The image forming apparatus according claim 1, wherein the drawer unit includes a door that is configured to be opened and closed to remove a recording medium from the recording medium conveying path, and a shaft direction of a rotary of the door is a direction perpendicular to a drawing direction of the drawer unit.

* * * * *